US009484665B2

(12) United States Patent
Wu et al.

(10) Patent No.: US 9,484,665 B2
(45) Date of Patent: Nov. 1, 2016

(54) CABLE CONNECTOR ASSEMBLY WITH IMPROVED STRAIN RELIEF AND METHOD OF MAKING THE SAME

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/734,251

(22) Filed: Jun. 9, 2015

(65) Prior Publication Data

US 2015/0357752 A1 Dec. 10, 2015

(30) Foreign Application Priority Data

Jun. 9, 2014 (CN) ..... 2014 1 0250899

(51) Int. Cl.

| | |
|---|---|
| ***H01R 13/56*** | (2006.01) |
| ***H01R 13/58*** | (2006.01) |
| *H01R 13/6581* | (2011.01) |
| *H01R 13/66* | (2006.01) |

(52) U.S. Cl.

CPC ..... *H01R 13/5845* (2013.01); *H01R 13/6581* (2013.01); *H01R 13/6658* (2013.01); *Y10T 29/49149* (2015.01)

(58) Field of Classification Search

CPC .. H01R 13/58; H01R 13/582; H01R 23/661; H01R 13/5825

USPC ..... 439/449, 362, 460, 447, 455

See application file for complete search history.

(56) References Cited

U.S. PATENT DOCUMENTS

| | | | | |
|---|---|---|---|---|
| 6,431,901 | B1 * | 8/2002 | Yeh | H01R 13/6275 439/188 |
| 7,648,372 | B2 * | 1/2010 | Wu | H01R 13/516 439/41 |
| 8,303,342 | B2 * | 11/2012 | Shi | H01R 24/60 439/607.41 |
| 8,517,751 | B1 * | 8/2013 | Golko | H01R 13/516 439/218 |
| 8,672,705 | B2 * | 3/2014 | Schneider | G02B 6/3887 439/460 |

(Continued)

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

A cable connector assembly includes a connector, a printed circuit board having a rear portion, a cable connected to the rear portion, a strain relief having a main portion, a shell having a front wall and a rear wall, an outer case enclosing the shell and having a front end face and a rear end face, wherein the main portion is disposed between the rear wall and the rear end face, and the main portion comprises at least one through hole. A method of assembling a cable connector assembly, the cable connector assembly including a connector, a printed circuit board, and a cable, the method comprising the steps of: over-molding a strain relief with the cable to have a main portion defining at least one through hole; disposing the printed circuit board in a shell; and mounting an outer case forwardly over the shell to press the strain relief.

6 Claims, 7 Drawing Sheets

(56) References Cited

U.S. PATENT DOCUMENTS 8,708,734 B2 * 4/2014 Su ..... H01R 9/03 439/452
2011/0256756 A1 * 10/2011 Lu ..... H01B 7/0892 439/449
2013/0075149 A1 * 3/2013 Golko ..... H01R 13/516 174/359
2013/0189872 A1 7/2013 Siahaan et al.
2013/0189873 A1 * 7/2013 Maranto ..... H01R 13/5845 439/460
2014/0235095 A1 * 8/2014 Jones ..... H01R 24/60 439/449
2014/0273650 A1 * 9/2014 Reeves ..... H01R 13/648 439/660

* cited by examiner

CABLE CONNECTOR ASSEMBLY WITH IMPROVED STRAIN RELIEF AND METHOD OF MAKING THE SAME

BACKGROUND OF THE INVENTION

1. Field of the Invention

The present invention relates to a cable connector assembly and method of making the same, and more particularly to an improved strain relief thereof 2. Description of Related Art U.S. Pat. No. 7,648,372, issued on Jan. 19, 2010, discloses a cable connector assembly comprising a connector, a printed circuit board having a front portion and a rear portion, a cable electrically connected to the rear portion of the printed circuit board, a strain relief disposed outside of the cable, an inner case enclosing the printed circuit board, and an outer case enclosing the inner case. The strain relief comprises a main portion and an extending portion connected with the main portion. The main portion defines a pair of gaps to clamp the rear portion of the printed circuit board.

U.S. Patent Application Publication No. 2013/0189872, published on Jul. 25, 2013, discloses a cable assembly including an inner strain-relief portion and an outer strain-relief portion. The inner strain-relief portion includes one or more interlocks to provide adhesion between the inner strain-relief portion and the outer strain-relief portion.

Strain-reliefs that present a solid structure, i.e., substantially inelastic when being pressed forwardly by an outer cover during assembling the latter, may cause problem in that the strain-relief is pressed by the outer cover and therefore tend to move forwardly, thus affecting the soldering connection between the cable and the printed circuit board. Moreover, due to inelastic property of strain-reliefs, it may be difficult to align the outer cover at a front of the cable connector assembly, thus resulting in an unpleasant appearance.

BRIEF SUMMARY OF THE INVENTION

Accordingly, an object of the present invention is to provide a cable connector assembly having an improved strain relief In order to achieve the above-mentioned object, a cable connector assembly includes: a connector, a printed circuit board having a rear portion, a cable electrically connected to the rear portion, a strain relief disposed outside of the cable and having a main portion, a shell shielding the printed circuit board and having a front wall and an opposing rear wall, and an outer case enclosing the shell and having a front end face and an opposing rear end face, wherein the main portion of the strain relief is disposed between the rear wall of the shell and the rear end face of the outer case, and the main portion comprises at least one through hole.

A method of assembling a cable connector assembly, the cable connector assembly including a connector, a printed circuit board electrically connected with the connector, and a cable soldered to the printed circuit board, comprises the steps of: over-molding a strain relief with the cable to have a main portion defining at least one through hole; disposing the printed circuit board in a shell; and mounting an outer case forwardly over the shell to press the strain relief.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
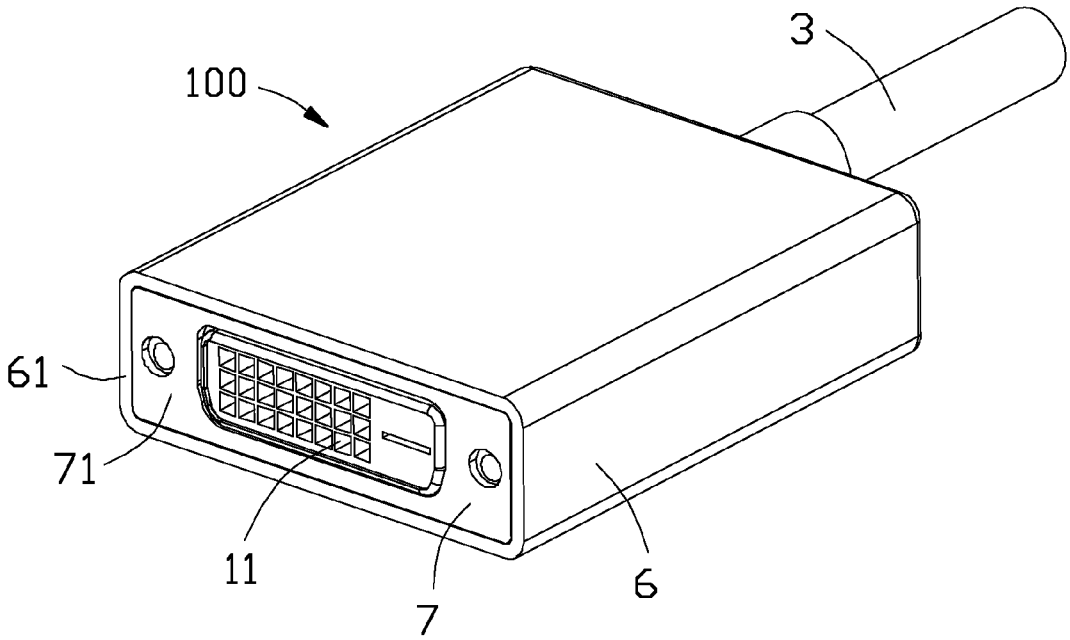
FIG. 1 is a perspective view of a cable connector assembly according to the present invention.
Figure 2:
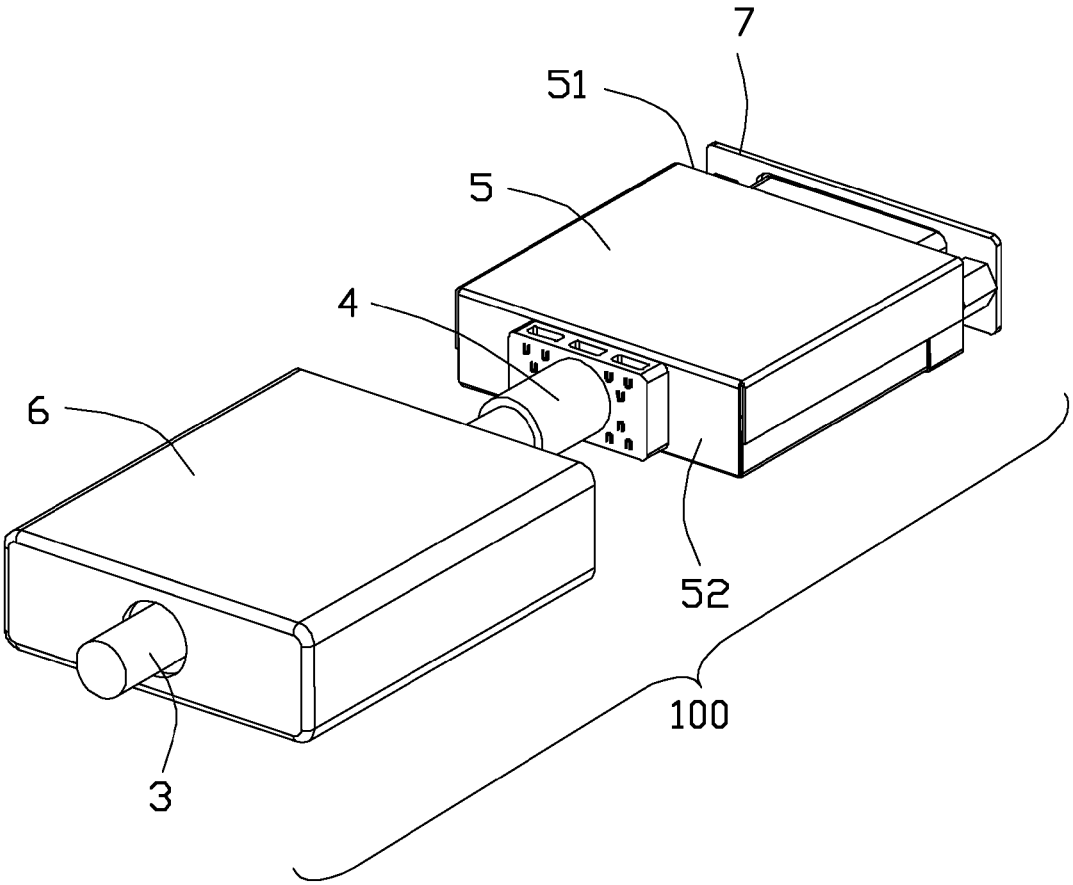
FIG. 2 is a partly exploded view of the cable connector assembly as shown in FIG. 1.
Figure 3:
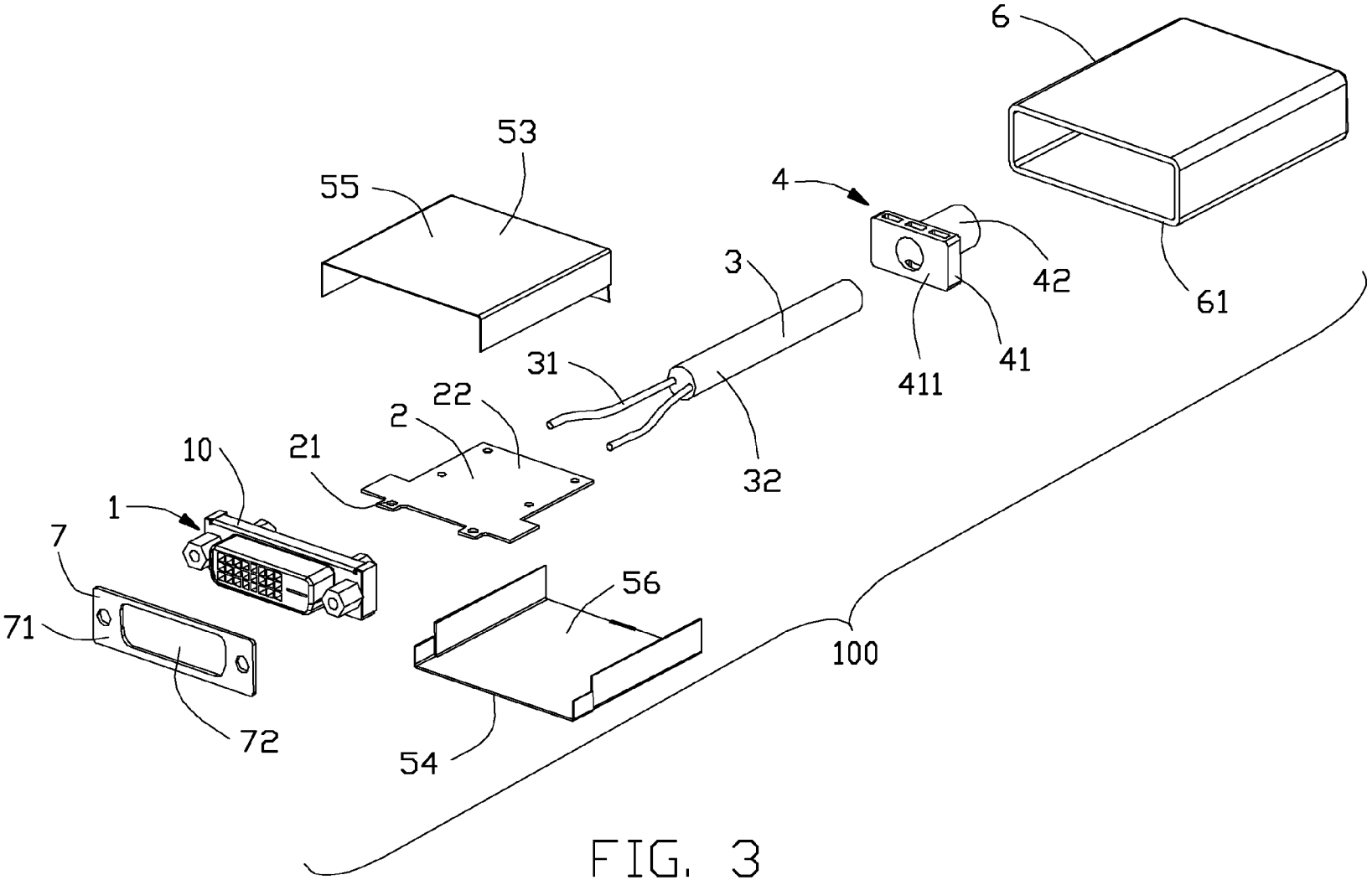
FIG. 3 is a further exploded view of the cable connector assembly as shown in FIG. 2 from another aspect.
Figure 4:
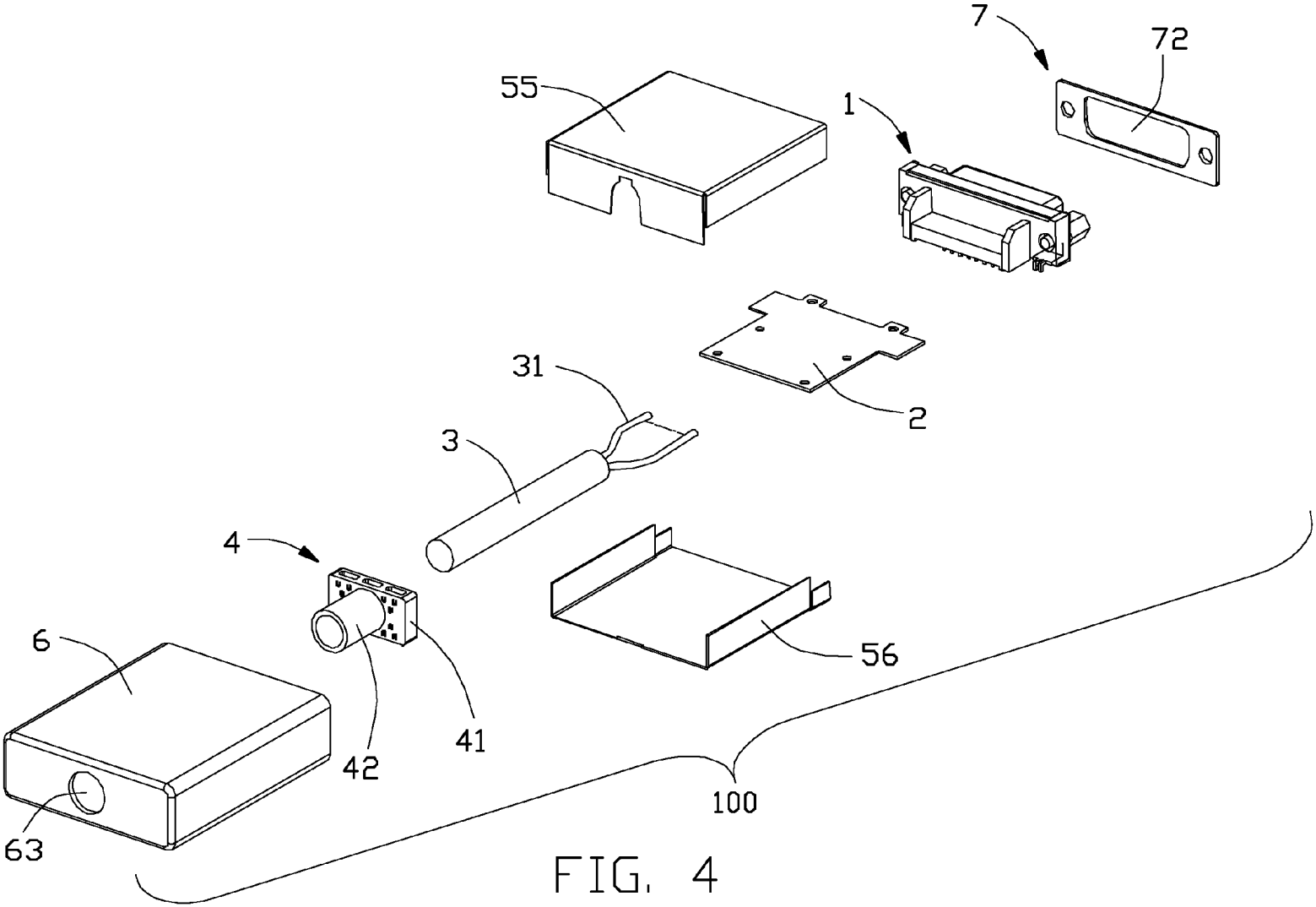
FIG. 4 is an exploded view of the cable connector assembly as shown in FIG. 3 from another aspect.
Figure 5:
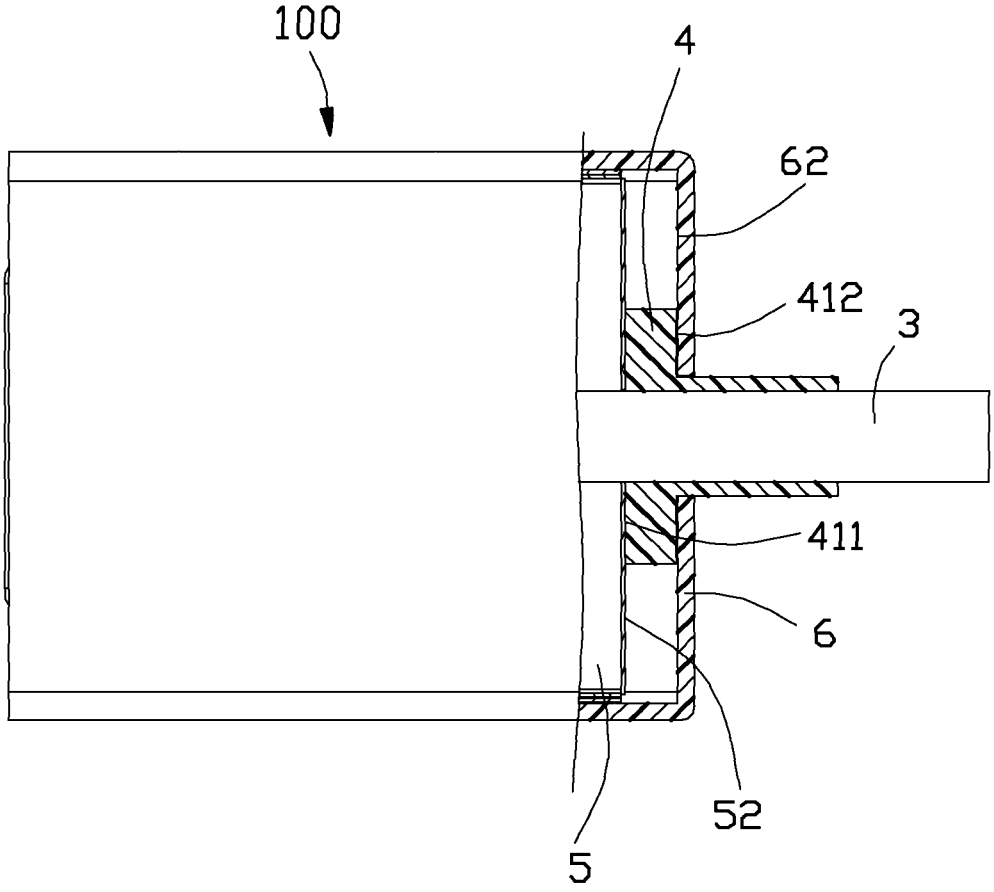
FIG. 5 is a partly cross section view of the cable connector assembly taken along line 5-5 in FIG. 1.
Figure 6:
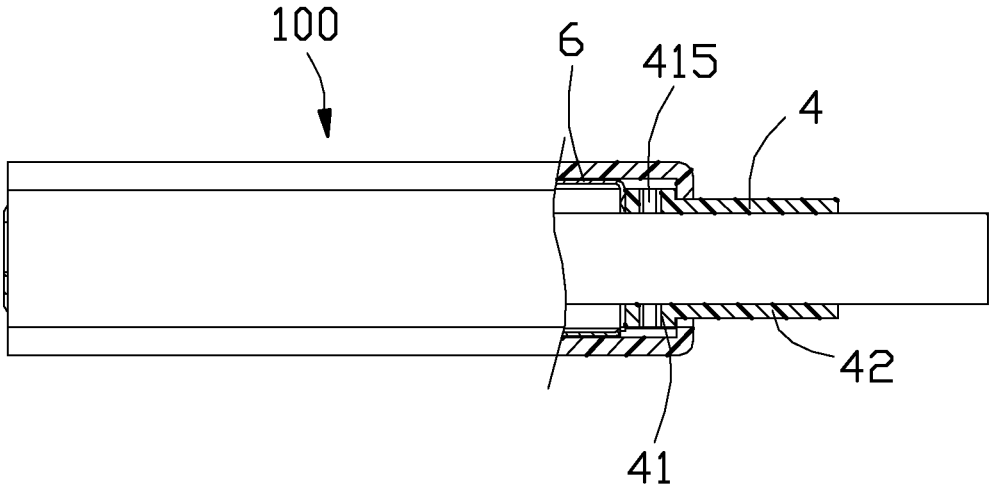
FIG. 6 is a partly cross section view of the cable connector assembly taken along line 6-6 in FIG. 1 from another aspect.
Figure 7:
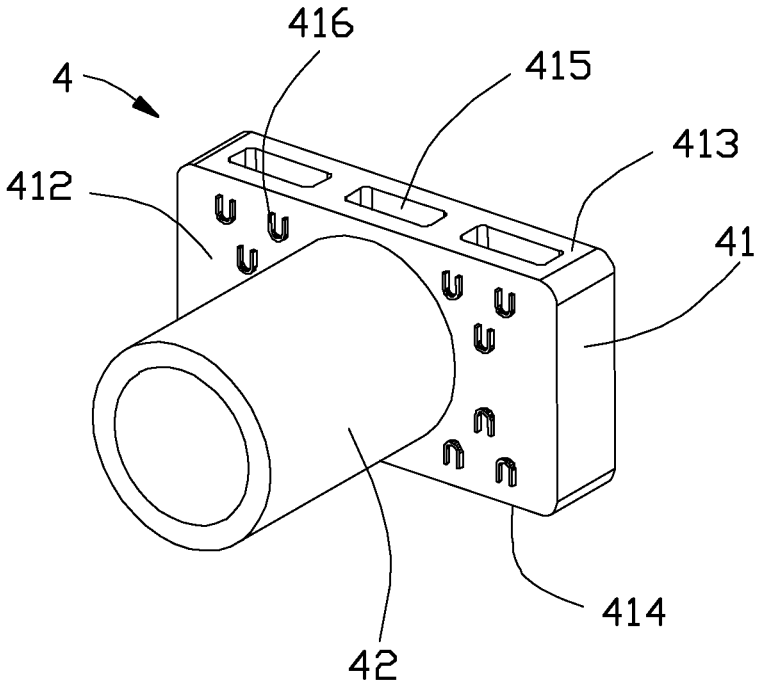
FIG. 7 is a perspective view of a strain relief of the cable connector assembly as shown in FIG. 1.

Referring to FIGS. 1 and 7, a cable connector assembly 100 in accordance with the present invention comprises a connector 1 for mating with a complementary connector (not shown), a printed circuit board 2 having a front portion 21 and a rear portion 22, a cable 3 electrically connected to the rear portion 22 of the printed circuit board 2, a strain relief 4 disposed outside of the cable 3, a shell 5 shielding the printed circuit board 2, an outer case 6 enclosing the shell 5, and a metal plate 7 mounted on the connector 1. The connector 1 comprises a body portion 10, a plurality of conductive contacts (not shown) electrically connected with the front portion 21 of the printed circuit board 2, and a plurality of contact slots 11 for receiving the conductive contacts. The metal plate 7 comprises a mating surface 71 and an opening 72 for the connector 1 to extend through.

The cable 3 comprises a plurality of conductive wires 31 and an outer layer 32 enclosing the conductive wires 31. The rear portion 22 of the printed circuit board 2 comprises plural soldering plates (not shown) to electrically connect with the conductive wires 31.

The strain relief 4 is integrally molded with the cable 3 and comprises a main portion 41 and an extending portion 42. The main portion 41 comprises a front surface 411, an opposing rear surface 412, an upper surface 413, a lower surface 414, at least one through hole 415 running through the upper surface 413 and the lower surface 414, and a plurality of projections 416 disposed on the rear surface 412. In this embodiment, the main portion 41 has three through holes 415. The through holes 415 and the projections 416 are all used to increase compressive deformation property or quantity of the strain relief 4 along a rear-to-front direction.

The outer case 6 comprises a front end face 61, a rear end face 62, and a hole 63 for the cable 2 running through. The main portion 41 of the strain relief 4 is located between the rear wall 52 of the shell 5 and the rear end face 62 of the outer case 6. The extending portion 42 extends beyond the rear end face 62 of the outer case 6. And a length of the outer case 6 in an extending direction of the cable 2 is larger than a length of the shell 5 in the extending direction. In this embodiment, the strain relief 415 can adjust the assembly variation of the outer case 6. And it is helpful to make the front end face 61 be flush with the mating surface 71 of the metal plate 7 in a vertical direction.

The shell 5 comprises a front wall 51, an opposing rear wall 52, an upper wall 53, and a lower wall 54. The shell 5 consists of an upper shell 55 and a lower shell 56 that are riveted together.

In assembling of the cable connector assembly 100, the printed circuit board is mounted on the lower shell 56. The strain relief 4 is integrally molded with cable 3. The main portion 41 of the strain relief 4 is compressed between the rear wall 52 of the shell 5 and the rear end face 62 of the outer case 6. Then plural conductive wires 31 are electrically connected with the corresponding soldering plates (not shown) of the printed circuit board 2 via a soldering process. And the upper shell 55 is connected with the lower shell 56 by riveting. Then, the cable 3 runs through the hole 63 of the outer case 6, and the outer case 6 is moved in the rear-to-front direction. In this invention, it has no gap between the front surface 411 of the main portion 41 and the rear wall 52 of the shell 5 by moving outer case 6. And it has no gap between the rear surface 412 of the main portion 41 and the rear end face 62 of the outer case 6 by moving outer case 6. Such design, when the external force acts on the strain relief 4 or cable 3, the external force will be transmitted to the outer layer 32 of the cable 3, the strain relief 4, and the shell 5. Instead of making the external force transmitted to the soldering area between the cable 3 and printed circuit board 2. In this invention, some glue can be applied on an outer surface of the upper wall 53 and an outer surface of the lower wall 54 in order to prevent the outer case 6 from exiting.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

a connector, a printed circuit board having a rear portion, a cable electrically connected to the rear portion, a strain relief disposed outside of the cable and having a main portion, a shell shielding the printed circuit board and having a front wall and an opposing rear wall, and an outer case enclosing the shell and having a front end face and an opposing rear end face, wherein the main portion of the strain relief is disposed between the rear wall of the shell and the rear end face of the outer case, and the main portion comprises at least one through hole; wherein the main portion comprises a front surface and a rear surface, the rear surface of the main portion comprising a plurality of projections.

2. The cable connector assembly as recited in claim 1, wherein the main portion is compressed between the rear wall of the shell and the rear end face of the outer case.

3. The cable connector assembly as recited in claim 1, wherein the at least one through hole runs through the main portion along a direction perpendicular to an extending direction of the cable.

4. The cable connector assembly as recited in claim 1, further comprising a metal plate mounted to the connector, the metal plate comprising a mating surface and an opening for the connector to at least partially extend through.

5. The cable connector assembly as recited in claim 1, wherein the strain relief comprises an extending portion extending from the main portion, the extending portion extending beyond the rear end face of the outer case.

6. The cable connector assembly as recited in claim 1, wherein the shell comprising an upper shell and a lower shell, and a length of the outer case in an extending direction of the cable is larger than a length of the shell in the extending direction.

* * * * *